US011098471B2

(12) United States Patent
Consolino

(10) Patent No.: US 11,098,471 B2
(45) Date of Patent: Aug. 24, 2021

(54) URINAL HYGIENE KIT WITH REPLACEABLE CUSTOMIZED SCREENS

(71) Applicant: Phillip Consolino, Fairburn, GA (US)

(72) Inventor: Phillip Consolino, Fairburn, GA (US)

( * ) Notice: Subject to any disclaimer, the term of this patent is extended or adjusted under 35 U.S.C. 154(b) by 0 days.

(21) Appl. No.: 16/700,207

(22) Filed: Dec. 2, 2019

(65) Prior Publication Data

US 2020/0102732 A1 Apr. 2, 2020

(51) Int. Cl.
*E03D 13/00* (2006.01)

(52) U.S. Cl.
CPC ..... *E03D 13/005* (2013.01)

(58) Field of Classification Search
CPC ..... E03D 13/005; A61L 9/05
See application file for complete search history.

(56) References Cited

U.S. PATENT DOCUMENTS 5,867,848 A 2/1999 Ort
6,920,648 B1 * 7/2005 Suski ..... E03D 13/00 4/222.1
7,202,201 B1 * 4/2007 Williams ..... A61L 9/01 510/191
9,243,394 B2 * 1/2016 Brown ..... E03D 13/00
10,267,027 B2 4/2019 D'Amico et al.
2008/0264810 A1 * 10/2008 Stewart ..... E03D 13/005 206/223
2017/0096808 A1 * 4/2017 D'Amico ..... A61L 9/05

* cited by examiner

*Primary Examiner* — Janie M Loeppke
(74) *Attorney, Agent, or Firm* — J.T. Hollin, Attorney-at-Law, P.C.

(57) ABSTRACT

Disclosed is a packaged kit of a plurality of date-specific urinal screens for facilitating the regular hygienic maintenance of urinals. Each of the screens contains at least one integral tab or "printpad" displaying one of a category of sequential time periods. The time-displayed printpad serves primarily as a notification of the insertion time, duration, and/or disposal/removal date applicable to an individual urinal screen. A user, subsequent to disposing of an expired urinal screen, will then insert the urinal screen displaying the next succeeding time period. A cavity which accommodates an enzyme block is located internally to each urinal screen, and serves to releases biodegradable surfactants. Each screen further comprises a plurality of ridges, spokes, crests, channels, various openings, and other physical features for the purpose of minimizing splashing and facilitating the flow of urine or flush water through the urinal.

8 Claims, 2 Drawing Sheets

URINAL HYGIENE KIT WITH REPLACEABLE CUSTOMIZED SCREENS

CROSS-REFERENCES TO RELATED APPLICATIONS

Figure 2:
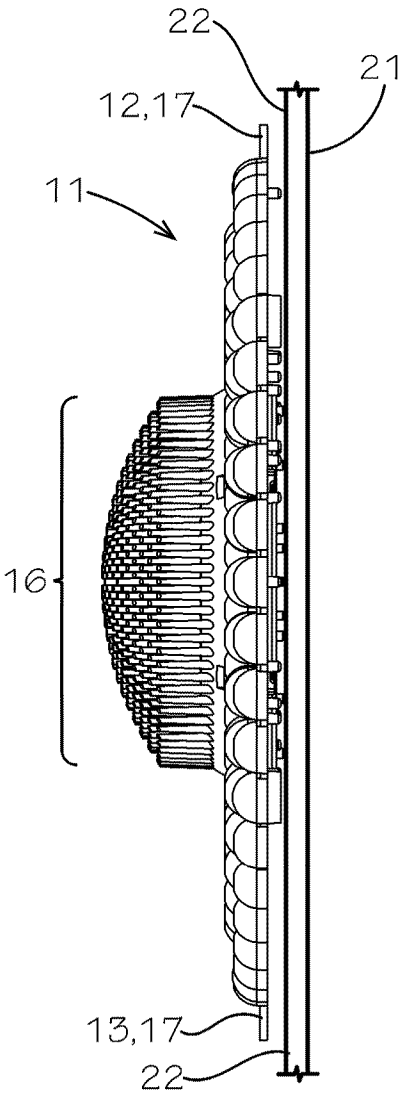

Not applicable.

STATEMENT REGARDING FEDERALLY SPONSORED RESEARCH OR DEVELOPMENT

Not applicable

NAMES OP THE PARTIES TO A JOINT RESEARCH AGREEMENT

Not applicable.

BACKGROUND OF THE INVENTION

(1) Field of the Invention

The field of the present inventive concept relates generally to methods and devices utilized to address hygiene concerns in public restrooms, particularly where urinals are provided. The need for sanitary public restroom facilities is an ongoing requirement worldwide. In the United States, Federal regulations require commercial buildings to provide restrooms for employees, while public restroom regulations are left up to the state and local municipalities.

The Occupational Safety and Health Administration (OSHA) is the government agency responsible for regulating bathroom access for employees in the workplace. Their sanitation standards require that all commercial buildings provide adequate bathroom facilities for their employees in an effort to avoid any adverse health effects. The only exception is mobile worksite: where transportation to bathrooms must be available.

According to OSHA, facilities with more than 15 employees must have gender-separated bathrooms. On the other hand, buildings with fewer than 15 employees require, at minimum, only one unisex bathroom (plus a sink and locking door).

With regard to urinals, it is noted that many designs of male urinal systems do not contain water at the time of their use. It is universally accepted that urinal screens con contribute to the hygiene of urinal systems. One situation to avoid is the lapse of an unreasonably long time period between cleaning of a urinal or changing a urinal screen. The inventive concept presented herein, the periodic hygiene kit 1

As an example, various states and municipalities have regulations regarding the frequency of cleaning of airport public bathrooms, which are used almost continuously, minute after minute, every day of the week. These public restroom requirements for cleaning vary from airport to airport. According to research conducted by USA Today, the following are examples of U.S. airports' cleaning schedules:

Atlanta Hartsfield-Jackson International Airport: men's bathrooms are cleaned every 15 minutes between 7 a.m. and 11 p.m.; women's restrooms cleaned on an ongoing basis between 7 a.m. and 11 p.m.; full cleaning of all restrooms takes place after midnight. At Cincinnati/Northern Kentucky Airport cleanings occur 3-4 times daily. Kennedy Airport in New York, the cleaning schedules varies by terminal, with hourly cleaning provided during peak times. At Honolulu International Airport, restrooms are cleaned hourly.

(2) Description of the Related Art, including information disclosed under 37 CFR 1.97 and 1.98. Following are devices and documents that resemble, in some respects, the inventive concept disclosed herein:

U.S. Pat. No. 9,243,394 (Jan. 26, 2016; inventor: Brown, et al) [Assignee: Fresh Products, Inc.] A urinal assembly having a screen body with a date feature corresponding to days, weeks, months, years, quarters or other time intervals. The date feature includes date tabs that may be removably attached to the screen body that may be removed or altered to indicate the desired date, such as a date of installation or expiry date of the urinal screen. The date feature and date tabs may be molded together with the remainder of the urinal screen body, forming one-piece construction made of a plastic material that may withstand the harsh environmental conditions within a urinal or toilet.

U.S. Pat. No. 5,867,848 (Feb. 9, 1999; inventor: Ort, R.) A thermochromic urinal display apparatus and method for displaying, a message when activated by a warm urine stream and terminating the display when the apparatus is rinsed with, cool rinse water. A urinal display screen is disclosed with advertisement, slogans, public service messages either painted, printed, screened or incorporated onto the urinal display screen using thermochromic paint, ink, film or decal. The urinal display screen is placed so that the thermochromic display is above the water line in the urinal reservoir. The warm urine stream activates the thermochromic paint to induce opaqueness or clarity to reveal advertising slogans, public service messages to the user. Once flushed the cool water from the urinal rinse deactivates the thermochromic paint so that it returns to its original state thereby becoming opaque to conceal an underlying message from the next user. The message can be printed in thermochromic paint in a quiescent transparent state to become activated and visible in its, active opaque state.

BRIEF SUMMARY OF THE INVENTION

A urinal of the type discussed in this inventive concept is, in its most common form, a specially-contoured porcelain, or metal, plumbing fixture for receiving urine discharged from a human male user. Urinals are frequently provided in toilets in public buildings, busses, aircraft, recreational vehicles, and other forms of transportation in Western countries. They are usually used by a male adult (or child) in a standing position. Urinals can be with automatic or manual flushing, or without flush water as is the case for waterless urinals. An important part of providing such urinals is the hygienic upkeep. The urinal hygiene kit 1 presented herein is a device which facilitates regular hygienic maintenance of urinals. The urinal hygiene kit 1 further incorporates an enzyme block 24 composed of naturally-occurring bacterial strains which produce enzymes to degrade the unpleasant smelling odors emanating from organic matter in urine.

Public urinals usually have a plastic mesh guard (or screen) directly over the area where urine is ejected into the urinal, the same area connecting to the urinal drainage. The urinal may optionally contain a deodorizing substance or deodorizer block, commonly referred to as a "urinal cake." The mesh, or screen, is intended to prevent solid objects (such as paper scraps, cigarette butts, chewing gum) from being flushed down the urinal drain and possibly causing a plumbing stoppage. The screen can also serve to mitigate the splashing of urine onto the floor. The undiluted urine is corrosive to metals (except for stainless steel), which is why plastic pipes are generally preferred for urine drain pipes.

As mentioned above, urinal deodorizer blocks, or urinal cakes, may be inserted into urinals. The urinal hygiene kit 1 disclosed displays a cavity 20 within which an enzyme block 24 is inserted. By way of comparison, other, less effective commercial forms for similar devices include pars blocks, urinal mints, urinal pucks, urinal peons (pee-ons), urinal biscuits, urinal cookies, hockey pucks, toilet pucks, toilet lollies, or urinal doughnuts.

The enzyme block 24 utilized in this inventive concept also reduces organic scale buildup by ensuring that uric acid is made more soluble, more readily decomposed, and therefore flushed away in a more environmentally friendly form.

The present inventive concept serves to impart some degree of predictable regularity into the universal need to maintain a urinal in a clean, hygienic condition as possible. Essentially, the urinal hygiene kit 1 is a container 7 displaying outer labeling 2 which identifies a packet 5 of twelve urinal screens 11, and the specific time-determined useful life cycle of the urinal screens 11. The urinal hygiene kit 1 is designed to form part of the regular equipment and supplies used by a custodian(s) of at least one public restroom where male urinals are among the restroom fixtures. In the preferred embodiment of this inventive concept, each of the twelve urinal screens 11 is labeled sequentially in accordance with the regular occurrence of months in a calendar year.

BRIEF DESCRIPTION OF THE VIEWS OF DRAWINGS AS EXEMPLARY EMBODIMENTS OF THE INVENTIVE CONCEPT

Figure 1:
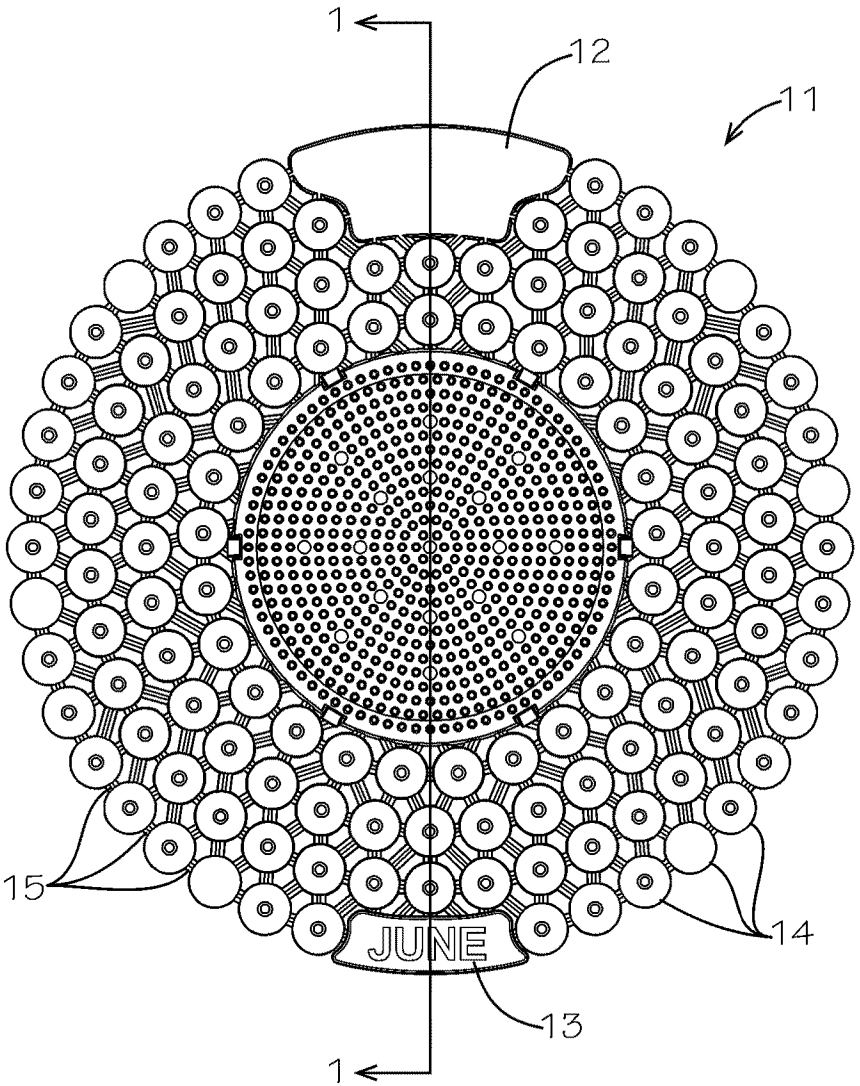

FIG. 1 is an illustration of the plan view of an exemplary urinal screen 11, further depicting the month of "JUNE" inscribed or printed upon the rearward "padprint" 13 of the urinal screen 11.

FIG. 2 depicts a profile view of the urinal screen 11 as it is shown placed atop the receiving surface 22 of a urinal 21, further showing the hub portion 16, protrusions 14, and base 17 of the urinal screen 11.

Figure 3:
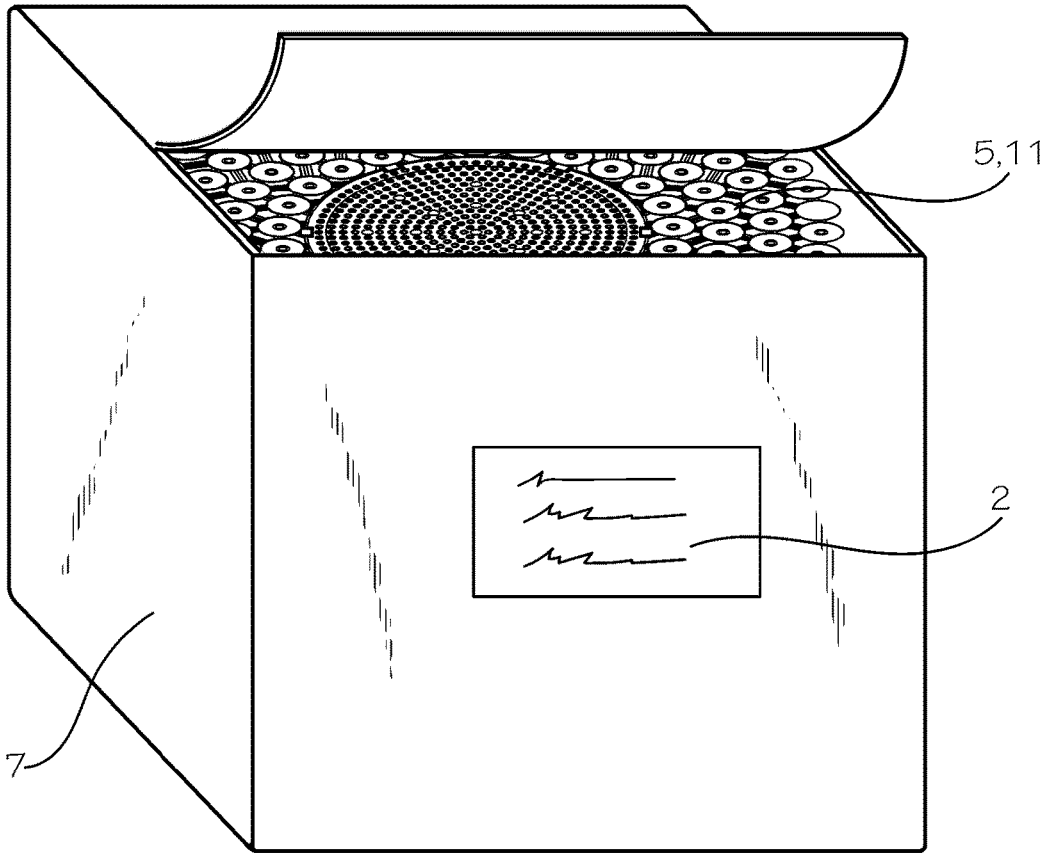

FIG. 3 depicts an exemplary container 7 which may hold either a month-based packet 5 of urinal screens 11 or a year-based packet 6 of urinal screens 11.

Figure 4:
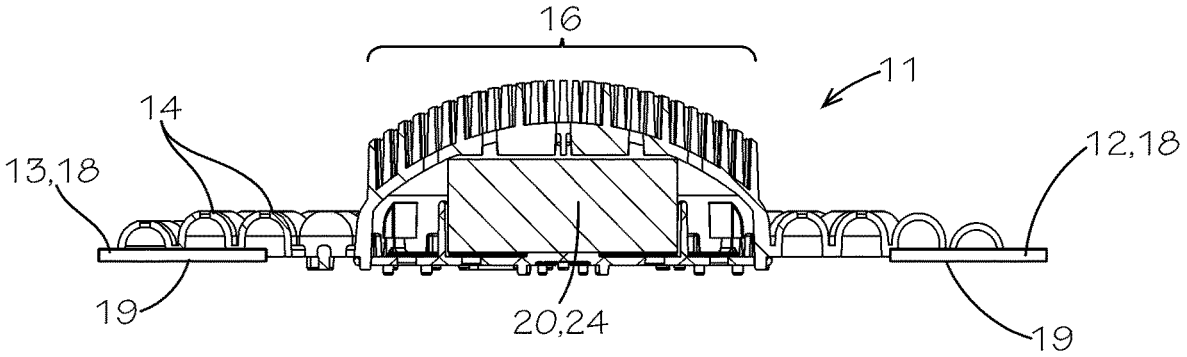

FIG. 4 depicts a cross-sectional view of the urinal screen 11 as seen from the perspective of section line 1-1 of FIG. 1.

DETAILED DESCRIPTION OF THE INVENTION

The objects, features, and advantages of the inventive concept presented in this application are more readily understood when referring to the accompanying drawings. The drawings, totaling four figures, show the basic components and functions of embodiments and for methods of use. In the several figures, like reference numbers are used in each figure to correspond to the same component as may be depicted in other figures.

The discussion of the present inventive concept will be initiated with FIG. 1, where there is shown, for illustrative purposes only, a plan view of a representative urinal screen 11. As is typically found in scoreless designs of urinal screens, the specific urinal screen 11 shown in FIG. 1 manifests a hub portion 16, spacings 15 to assist in free flow of urine and/or flushing water, protrusions 14 to ameliorate splashing, and a base 17. When installed, the base 17 rests upon some portion of the receiving surface 22 of a urinal 21.

FIG. 1 depicts a forward "padprint" 12, being a planar sector of material which is constructed integral to the upper surface 18 of the base 17 of the urinal screen 11. The forward padprint 12 is further composed of a texture and material suitable for printing, engraving, or applying raised lettering within its confines for the purpose of promotional and advertising features.

As part of the distinctive functional aspects of the urinal hygiene kit 1, a rearward padprint 13, as shown in FIG. 1, is utilized for printing, engraving, or otherwise placing the name of one of a specifically determined category of time intervals. In FIG. 1, for exemplary purposes only, and not as a means of limitation, the English word for the month of "JUNE" is displayed on the rearward printpad 13. It is to be noted that the months on the rearward printpad may be displayed in languages such as English, Mandarin Chinese, Hindi, Spanish, French, Standard Arabic, Bengali, German, Portuguese, Indonesian, Dutch, Bulgarian, Danish, Hebrew, Japanese, Italian, Swedish, Swahili, Turkish, Ukrainian, and/or Vietnamese. This serves as a permanent indication of the month of June as the useful life of this particular urinal screen 11, in conformance with the use of a monthly based time integral.

With this arrangement, the next urinal screen 11 in sequence in this hygiene kit 1 would have the word "July" imprinted/engraved on its rearward printpad 13, and so on. Such a packet of sequentially-identified urinal screens 11 would be referred, to as a "month-based packet" 5.

The rear padprint 13 is constructed upon the lower outer perimetral segment the urinal screen 11, (relative to the upper and lower sectors of FIG. 1). In this manner, the rear padprint 13, containing the relevant time interval will appear closest to the user of the urinal 21. The rearward padprint 13 is arranged in a space along the perimeter of the lower edge of the urinal screen 11 so as to be readily noticeable.

To serve its intended purpose, the urinal screen 11, when placed upon the receiving surface 22 of the urinal 21 should be oriented such that the rearward padprint 13 is always closest to a user standing proximate the urinal 21. In this manner, the printing/engraving on both the forward pad print 12 and the rearward padprint 13 are readily discernible.

The ultimate commercial customer ordering a quantity of the urinal hygiene kit(s) 1 will, preliminarily, make the determination of the time interval at which the urinal screen (or screens) 11, at each urinal 21 location must be replaced, in the preferred embodiment, one urinal hygiene kit 1 contains twelve (12) individual urinal screens 11 packaged within a container 7. Further, the recommended time interval to be adhered to, with respect to regular replacement of urinal screens 11, is one month. A month is defined as one of the individual months of the Gregorian calendar, including the total number of days in each such individual month. Accordingly, each of the urinal screens 11 has displayed, upon its rearward padprint 13, a separate and unique month al the Gregorian calendar.

FIG. 2 depicts a profile view of the urinal screen 11 as it is shown placed atop the receiving surface 22 of a urinal 21, further showing the hub portion 16, protrusions 14, and base 17, and upper surface 18 of the urinal screen 11.

FIG. 3 depicts an exemplary container 7 which may hold either a month-based packet 5 of urinal screens 11 or a year-based packet 6 of urinal screens 11.

FIG. 4 depicts a cross-sectional view of the urinal screen 11 as seen from the perspective of section line 1-1 of FIG. 1. Also illustrated is a cavity 30, within which the enzyme block 24 is inserted. The naturally-occurring bacterial strains of the enzyme block 24 are stable in product formulations and become chemically active once released into the restroom environment. Upon release, these formulations colonize surface areas of a urinal, and further, cleanse downstream plumbing surfaces, thereby producing a continuous supply of enzymes to break down organic matter. As a protective measure, and to ensure the effectiveness of the enzyme block, each urinal screen 11 is individually enclosed within a clear, airtight plastic wrap 25.

A first modification of the preferred embodiment would consist of preparing a packet of urinal hygiene kits 1 with twelve identical urinal screens 11. The essence of this modification manifests by each of the twelve urinal screens 11 displaying the same month of the Gregorian calendar engraved/printed upon the rearward padprint 13. This particular modification of the urinal hygiene kit 1 is referred to as the "year-based packet" 6.

Consequently, the year-based packet 6 would require the production of twelve different packets of urinal hygiene kits 1, to be respectively disposed within twelve separate, distinct containers 7. Each such container 7 of each of the respective urinal hygiene kits 1 would necessarily display outward labeling 2 setting forth the name of the particular month appearing on the rearward padprints 13 of all of the urinal screens 11 within the container 7. The year-based packet 6 arrangement would provide a substantial degree of convenience for custodians or janitorial personnel at locations where a considerable number of urinals 21 in one building, or on one floor of a building must be hygienically maintained.

In carrying out the objective of the inventive concept, the person responsible for the periodic cleaning of a urinal 21, if utilizing the urinal hygiene kit 1, is made visually aware of the specifically determined time interval at which, upon expiration of the time interval, the urinal screen 11 should be replaced. Upon expiration of such time interval, the currently functioning urinal screen 11 will be removed and a replacement urinal screen 11 having the printed/engraved name of the successive time interval will be placed upon the upper surface 18 of the subject urinal 21.

The urinal hygiene kits 1 thus far described, must utilize a container 7 which bears exterior labeling 2 displaying date-specific written advisory of the intended start of the designated time interval. By way of example only, and not as a limitation, the designated time interval may be a month, ten days, or other interval deemed most effective by the user. Further, other written reminders may be placed on the labeling 2 of the container 7, such as month of use, start date, the length of time of hygienic effectiveness of, for instance, a deodorant cake, and the deadline for removal and replacement of currently installed urinal screen(s) 11.

While preferred embodiments of the present inventive method have been shown and disclosed herein, it will be obvious to those persons skilled in the art that such embodiments are presented by way of example only, and not as a limitation to the scope of the inventive concept. Numerous variations, changes, and substitutions may occur or be suggested to those skilled in the art without departing from the intent, scope, and totality of this inventive concept. Such variations, changes, and substitutions may involve other features which are already known per se and which may be used instead of, in combination with, or in addition to features already disclosed herein. Accordingly, it is intended that this inventive concept be inclusive of such variations, changes, and substitutions, as described by the scope of the claims presented herein.

What is claimed is:

1. A urinal hygiene kit to facilitate the systematic, regularly-conducted hygienic maintenance of a single urinal, the hygiene kit comprising:

(a) a packet of a plurality of urinal screens, wherein each urinal screen further comprises (i) an integral forward padprint having a composition and texture which provides for the printing, engraving, and/or display of promotional and advertising features; (ii) an integral rearward padprint of a composition and texture which provides for the printing, engraving, and/or display of one of a specifically-determined category of time intervals; wherein each specifically determined time interval is one of the individual months of the Gregorian calendar, including the total number of days in such month, and further, wherein each of the urinal screens has exclusively printed upon its rearward padprint a separate one of the respective months of the Gregorian calendar; and (iii) an internal enzyme block which produces naturally-occurring bacteria to degrade organic matter; and (b) a container for (i) storing of the packet and (ii) displaying labeling which advises a user of the manner of utilization of the urinal screens corresponding to the sequentially occurring time interval.

2. A urinal hygiene kit as in claim 1, wherein the printing, engraving and or display of both the promotional advertising features and the specifically-determined time interval are written in the English language.

3. A kit as in claim 1, wherein the specifically-determined time interval is written in any one of a language selected from the group consisting of English, Mandarin Chinese, Hindi, Spanish, French, Standard Arabic, Bengali, German, Portuguese, Indonesian, Dutch, Bulgarian, Danish, Hebrew, Japanese, Italian, Swedish, Swahili, Turkish, Ukrainian, and Vietnamese.

4. A kit as in claim 1, wherein each one of the plurality of urinal screens comprises a color distinct from the other urinal screens.

5. A urinal hygiene kit to facilitate the systematic and regularly-conducted hygienic maintenance of a plurality of urinals, the hygiene kit comprising:

(a) an assemblage of a number of distinct packets, wherein each packet is comprised of a plurality of urinal screens, each urinal screen having (i) an integral forward padprint having a composition and texture which provides for the printing, engraving, and/or display of promotional and advertising features; (ii) an integral rearward padprint of a composition and texture which provides for the printing, engraving, and/or display of one of a specifically-determined segment or category of time intervals; herein each specifically-determined time interval is one of the twelve months of the Gregorian calendar; the kit comprises twelve distinguishable packets; each packet contains a minimum of twelve urinal screens, each urinal screen further having printed upon its rearward padprint the name of a distinct one of the twelve months of the Gregorian calendar; and each packet exteriorly displays labeling which advises of the utilization of the urinal screens contained therein; and (iii) an internal enzyme block which produces naturally-occurring bacteria to degrade organic matter;

(b) an engraved or written display, on the rearward padprint of each of the urinal screens which comprise a specific packet, indicating the exact same designation of a time interval; and (c) a sufficient plurality of containers for (i) separately accommodating the storage of each of the aforesaid distinct packets in a separate container and (ii) exteriorly displaying labeling which advises of the utilization of the urinal screens comprising the internally-stored packet.

6. A urinal hygiene kit as in claim 5, wherein the printing, engraving, and or display of both the promotional and advertising features and the specifically-determined time interval are written in the English language.

7. A kit as in claim 5, wherein the date-specific time interval is written in any one of a language selected from the group consisting of English, Mandarin Chinese, Hindi, Spanish, French Standard Arabic, Bengali, German, Portuguese, Indonesian, Dutch, Bulgarian, Danish, Hebrew, Japanese, Italian, Swedish, Swahili, Turkish, Ukrainian, and Vietnamese.

8. A kit as in claim 5, wherein each of the plurality of urinal screens comprises a color distinct from the other remaining distinct urinal screens.

* * * * *